US005764115A

United States Patent [19]

Hattori et al.

[11] Patent Number: 5,764,115

[45] Date of Patent: Jun. 9, 1998

[54] DIELECTRIC RESONATOR APPARATUS WITH MAGNETIC FIELD COUPLING LOOP

[75] Inventors: Jun Hattori, Takatsuki; Tomiya Sonoda, Mukoh; Masamichi Andoh, Kyoto, all of Japan

[73] Assignee: Murata Manufacturing Co., Ltd., Japan

[21] Appl. No.: 700,862

[22] Filed: Aug. 21, 1996

[30] Foreign Application Priority Data

Aug. 21, 1995 [JP] Japan ..... 7-211854

[51] Int. Cl.[6] ..... H01P 1/20

[52] U.S. Cl. ..... 333/202; 333/219.1; 333/230

[58] Field of Search ..... 333/202, 202 DB, 333/202 DR, 208, 209, 219, 219.1, 230

[56] References Cited

FOREIGN PATENT DOCUMENTS 0089302 6/1982 Japan ..... 333/202 DB

8065005 A2 3/1996 Japan .

*Primary Examiner*—Robert Pascal

*Assistant Examiner*—Babara Summons

*Attorney, Agent, or Firm*—Ostrolenk, Faber, Gerb & Soffen, LLP

[57] ABSTRACT

A dielectric resonator apparatus includes a plurality of TM double-mode dielectric resonators. Each dielectric resonator has a dielectric rod-complex, a casing provided with electrically conductive film at the outside surfaces, and metal panels covering the upper and lower openings of the casing. In adjacent TM double-mode dielectric resonators, at portions of the planes of the two casings opposing each other, apertures are provided in the direction of the magnetic field generated by two dielectric rods which have the same axial direction. A coupling member is also provided so as to form an electrically conductive loop which goes across the magnetic field.

14 Claims, 8 Drawing Sheets

DIELECTRIC RESONATOR APPARATUS WITH MAGNETIC FIELD COUPLING LOOP

BACKGROUND OF THE INVENTION

1. Field of the Invention

The present invention relates to a dielectric resonator apparatus having a plurality of TM multiple-mode dielectric resonators.

2. Description of the Related Art

An apparatus having a plurality of TM multiple-mode dielectric resonators has been provided as a microwave band filter. In such an apparatus, each of the dielectric resonators is formed by a dielectric resonator rod complex in which dielectric rods intersect within a casing having electrical conductivity. The resonator rods are electromagnetically coupled to each other.

Various types of configuration have been proposed for the resonators as well as for the resonator rods, to obtain a filter having desired characteristics.

Generally, in a TM multiple mode dielectric resonator apparatus, a partition wall is provided between dielectric resonators to generate magnetic coupling between resonator rods in different adjacent resonators. However, in such an apparatus, it is difficult to prevent undesired coupling between dielectric rods other than the intended coupling. This causes the problem that the resultant filter has unexpected electrical characteristics.

To solve this problem, the inventors have already submitted Japanese Patent Application No. 6-201937 which discloses a coupling window, provided in a partition wall, for selectively coupling the resonator rods.

FIG. 9 is a perspective view showing a dielectric resonator apparatus disclosed in the above-described Japanese application. The apparatus includes TM double-mode dielectric resonators 1*a* and 1*b*. Metal plate lids attached to the upper and lower surfaces of casings 15*a* and 15*b* are omitted in the figure. The TM double-mode dielectric resonators 1*a* and 1*b* are composed of dielectric resonator rod complexes 10*a* and 10*b* respectively. Outside surfaces of casings 15*a* and 15*b* are coated by electrically conductive films 2*a* and 2*b*. In the walls opposing each other of the casings 15*a* and 15*b*, coupling apertures (notches) 28*a* and 28*b* are provided. Since these coupling apertures 28*a* and 28*b* are not provided with electrically conductive film, and since they are disposed along the direction of the magnetic field generated along two dielectric rods 11*a* and 11*b* which are serially aligned on the same axis, these two dielectric rods 11*a* and 11*b* are magnetically coupled. Further, because grooves "g" are formed at the intersection of the dielectric rods 11*a* and 12*a*, and the intersection of the dielectric rods 11*b* and 12*b*, the respective two modes of the rods are coupled. Therefore, assuming that a resonator made up of the dielectric rod 12*a* serves as the first resonator, for example, the dielectric rods are coupled in the order of 12*a*, 11*a*, 11*b*, and 12*b* to operate as a filter made up of four resonators.

In the resonator apparatus shown in FIG. 9, the coupling window combines the rods 11*a* and 11*b* to form a new resonator. The center of coupling frequency is lower than the resonant frequency of each resonator itself. The center of the coupling frequency $f_c$ changes as the coupling coefficient k changes according to the size of the apertures. FIG. 10 shows the relationship thereof. The horizontal axis indicates the coupling coefficient k, and the vertical axis indicates the coupling frequency $f_c$. When the coupling coefficient k is changed according to the size of the apertures, the odd-mode frequency $f_{odd}$ is almost constant, while the even-mode frequency $f_{even}$ is reduced as the coupling coefficient k increases, and the coupling frequency $f_c$ is reduced as the coupling coefficient k increases.

Generally, the relations between the above described parameters are represented by the following equations:

$$f_c=(f_{even}+f_{odd})/2 \quad (1)$$

$$k=2\cdot\text{abs}((f_{odd}-f_{even})/(f_{even}+f_{odd})) \quad (2)$$

Therefore, the resonant frequency itself of a resonator rod changes as the size of the coupling apertures changes. This increases the number of steps required in manufacturing the resonator apparatus, since the coupling coefficient k cannot be adjusted after assembly just by adjusting the coupling apertures. Even when a mechanism for adjusting the aperture area is provided for the coupling apertures, for example, an adjustment range for the coupling coefficient is very small, thus variations caused by differences in dimension between work pieces cannot be compensated for.

SUMMARY OF THE INVENTION

Accordingly, it is an object of the present invention to provide a dielectric resonator apparatus in which the coupling coefficient k is easily adjusted, and also in which the range of adjustment is wider than in a conventional apparatus.

Another object of the present invention is to provide a dielectric resonator apparatus having six resonators or more by disposing a plurality of TM multiple-mode dielectric resonators such that dielectric rod complexes are aligned in a common virtual plane and by coupling adjacent resonators through an electrically conductive loop.

An embodiment of the present invention has a dielectric resonator apparatus including first and second TM multiple mode dielectric resonators, the resonators being placed adjacent to each other, and each resonator having: a casing which has an electrical conductivity, a dielectric rod-complex provided in the casing, the rod-complex having dielectric rods intersecting with each other; apertures provided in opposing walls of the casings of the first and second resonators so that the apertures pass through and cross a magnetic field generated along the respective dielectric rods, whose axes are substantially perpendicular to said apertures; and a conductive loop transverse to said apertures which causes a magnetic coupling between the dielectric rods.

According to another aspect of the present invention, a dielectric resonator apparatus may include a conductive metal rod which is movable near the conductive loop to adjust an amount of said magnetic coupling. The dielectric resonator apparatus may also have a support portion for supporting the metal rod, provided in a wall of the casing near the conductive loop. The conductive metal rod may be a screw member, and the support portion may have screw threads so that the amount of the magnetic coupling can be adjusted by turning the screw member to control a distance between the conductive loop and the conductive metal rod.

According to a further aspect of the present invention, a dielectric resonator apparatus may have a second, flexible metal plate provided near the above-mentioned conductive metal plate; and a member for pressing the second metal plate toward the conductive metal plate to adjust the amount of magnetic coupling.

In accordance with embodiments of the present invention, dielectric rods which are arranged in the same axial direction are selectively coupled with each other through the conductive loop. Thus, it is possible to change the coupling coefficient k by altering the loop area. In such a system, the center of a coupling frequency $f_c$ is kept more constant, as described later, in comparison with the conventional system, even if the coupling coefficient k is changed.

In other words, changes in the resonant frequency of the individual dielectric rods are avoided when the coupling coefficient k is changed. This enables the resonator apparatus to be provided with various characteristics without changing its dielectric parts.

In accordance with another aspect of the present invention, an apparatus composed of multiple resonators is provided, the apparatus including: a plurality of dielectric resonators, the resonators being aligned in series, each of the resonators having: a casing which has electrical conductivity, a dielectric rod-complex provided in the casing, the rod-complex having dielectric rods intersecting with each other; apertures provided in opposed walls of the casings of the dielectric resonators so that the apertures pass through and cross a magnetic field generated along the respective dielectric rods, whose axes are substantially perpendicular to said apertures; a first conductive loop provided in at least one of the apertures, the first conductive loop crossing a magnetic field generated by dielectric rods substantially perpendicular to the apertures; a second conductive loop provided in at least another one of the apertures, the second conductive loop crossing a magnetic field generated by dielectric rods substantially parallel to the apertures.

Other aspects and advantages of the invention will be seen in the following detailed description of several embodiments thereof.

DETAILED DESCRIPTION OF EMBODIMENTS OF THE INVENTION

The configuration of a dielectric resonator apparatus according to a first embodiment of the present invention will be described below by referring to FIGS. 1 to 5.

Figure 1:
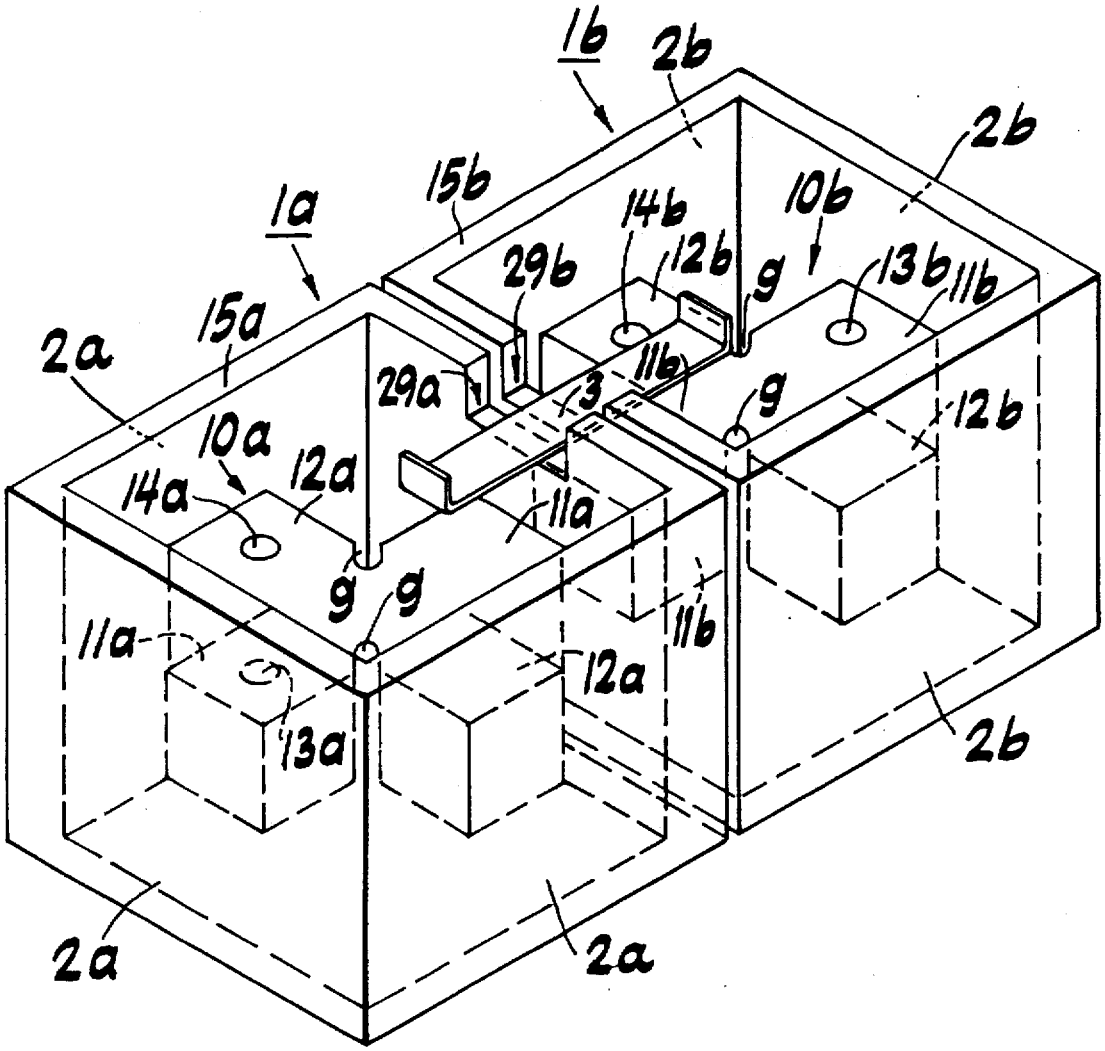
FIG. 1 shows a configuration of two dielectric resonators used in a dielectric resonator apparatus according to a first embodiment of the present invention.

In FIG. 1, there are shown TM double-mode dielectric resonators 1*a* and 1*b*. A pair of metal panels respectively covering the upper and lower opening planes of casings 15*a* and 15*b* are omitted. The TM double-mode dielectric resonator la includes a dielectric rod-complex 10*a*, a casing 15*a* provided with electrically conductive film 2*a* on its outside surfaces, and the pair of metal panels covering the upper and lower opening planes of the casing 15*a*. Similarly, the TM double-mode dielectric resonator 1*b* includes a dielectric rod-complex 10*b*, a casing 15*b* provided with electrically conductive film 2*b* on its outside surfaces, and the same pair of metal panels also covering the upper and lower opening planes of the casing 15*b* in addition to those of the casing 15*a*.

The dielectric rod-complex 10*a* has dielectric rods 11*a* and 12*a* intersecting with each other and is integrally formed together with the casing 15*a*. It may be produced by means of molding. Also, the casing and the dielectric rod complex may be produced separately. In the same way, the dielectric rod-complex 10*b* has dielectric rods 11*b* and 12*b* intersecting with each other and is integrally formed together with the casing 15*b*. On the outside surfaces of the casings 15*a* and 15*b*, electrically conductive film 2*a* and 2*b* is formed by baking silver paste.

At the intersection of the two dielectric rods in the dielectric rod-complex 10*a*, grooves "g" are formed so as to cause a difference between the resonant frequencies in the odd mode and the even mode generated by the dielectric rods 11*a* and 12*a* in order to couple the two resonators made up of the dielectric rods 11*a* and 12*a*. In the same way, the intersection of the two dielectric rods in the dielectric rod-complex 10*b* is provided with grooves "g" to cause a difference between the resonant frequencies in the odd mode and the even mode generated by the dielectric rods 11*b* and 12*b* in order to couple the two resonators made up of the dielectric rods 11*b* and 12*b*.

The dielectric rods 11*a*, 12*a*, 11*b*, and 12*b* are also provided with resonant frequency-adjusting holes 13*a*, 14*a*, 13*b*, and 14*b* in the direction perpendicular to the plane formed by the dielectric rod-complexes, respectively. To adjust the resonant frequencies of the dielectric rods, conductive metal bars (not shown) may be inserted into the holes from the outside of the casing through apertures provided, for example, in the upper covering metal panel.

In respective parts of the casings 15*a* and 15*b*, apertures 29*a* and 29*b* are provided to cross the magnetic field generated by the two dielectric rods 11*a* and 11*b* which are arranged in the same axial direction. A coupling member 3 made by folding a metal plate is located so as to pass through the apertures 29*a* and 29*b*. This coupling member 3 is secured to the metal panel covering the upper opening planes of the casings 15*a* and 15*b*. The coupling member 3 is mounted in advance to the metal panel at a predetermined position by soldering or other methods, the panel is placed on the upper opening planes of the casings 15*a* and 15*b*, and then the metal panel is soldered to the electrically conductive film of the casings 15*a* and 15*b* through a ground plate (which may be a thin metal plate) at the circumference of the panel. The lower metal panel, to which input and output connectors and coupling loops are mounted, is mounted at the lower opening planes of the casings in the same way.

An adjusting-member holding section (not shown) which holds frequency adjusting members for the frequency adjusting holes 13*a*, 14*a*, 13*b*, and 14*b* at adjustable insertion amounts, and which also holds coupling adjustment members for the grooves "g" at adjustable insertion amounts, is mounted between the casings 15*a* and 15*b* and either the upper metal panel or the lower metal panel, such that frequency adjustment and coupling adjustment may be performed at the upper or lower metal panel.

Figure 2A:
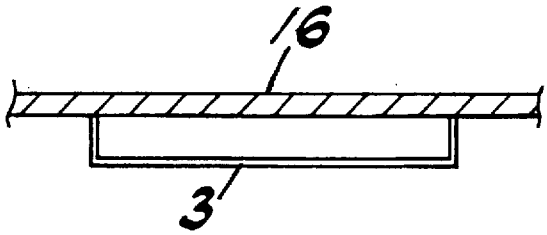
FIGS. 2(A) and 2(B) are partial cross-sections showing examples of coupling members.
Figure 2B:
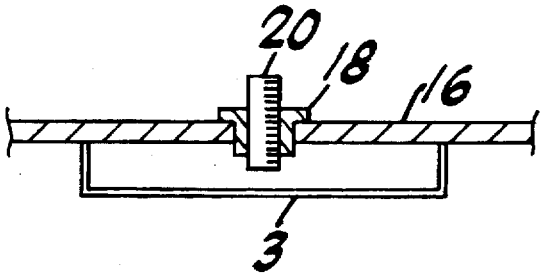

In FIGS. 2(A) and 2(B), there is shown a metal panel 16 for covering the upper opening planes of the casings 15*a* and 15*b* shown in FIG. 1. The coupling member 3 is mounted to the inside surface of the metal panel 16 by soldering or by another method. Therefore, the coupling member 3 and the metal panel 16 form an electrically conductive loop. FIG. 2(B) shows a metal panel 16 provided with a coupling-adjusting mechanism. An opening is made in the metal panel 16, a metal bush 18 is mounted therein, and a metal screw is put into the bush. By turning the metal screw 20 from the outside, the area of the electrically conductive loop formed by the coupling member 3 and the metal panel 16 may be adjusted.

Figure 3:
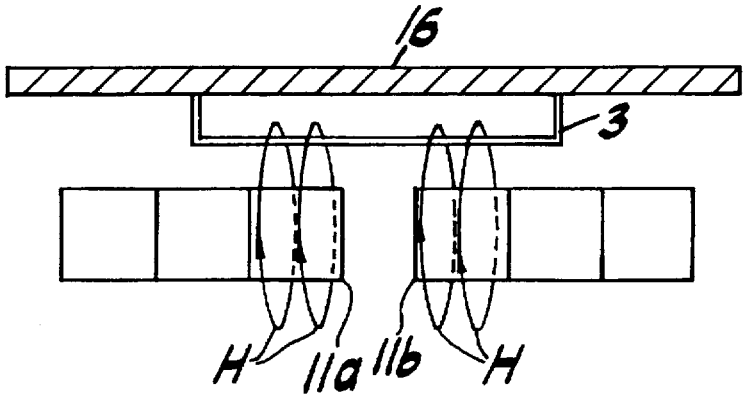
FIG. 3 illustrates a way of coupling between resonators through a coupling member.

FIG. 3 shows magnetic lines of force H which indicate an example of the magnetic field generated by the dielectric rods 11*a* and 11*b*, and the coupling member 3. The two dielectric rods 11*a* and 11*b* whose shafts are oriented in the same direction are magnetically coupled through the coupling member 3.

Figure 4:
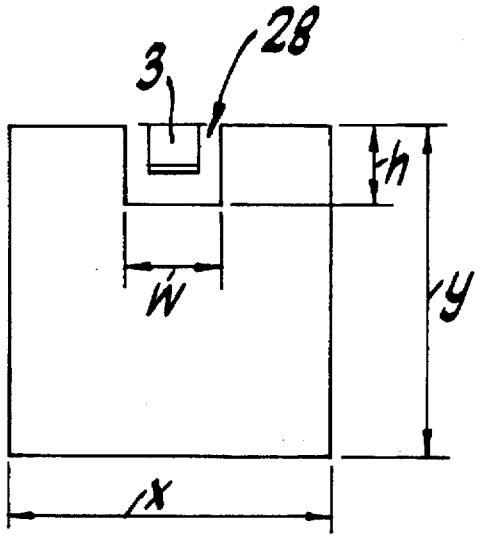
FIG. 4 shows dimensions of a casing and an aperture.
Figure 5:
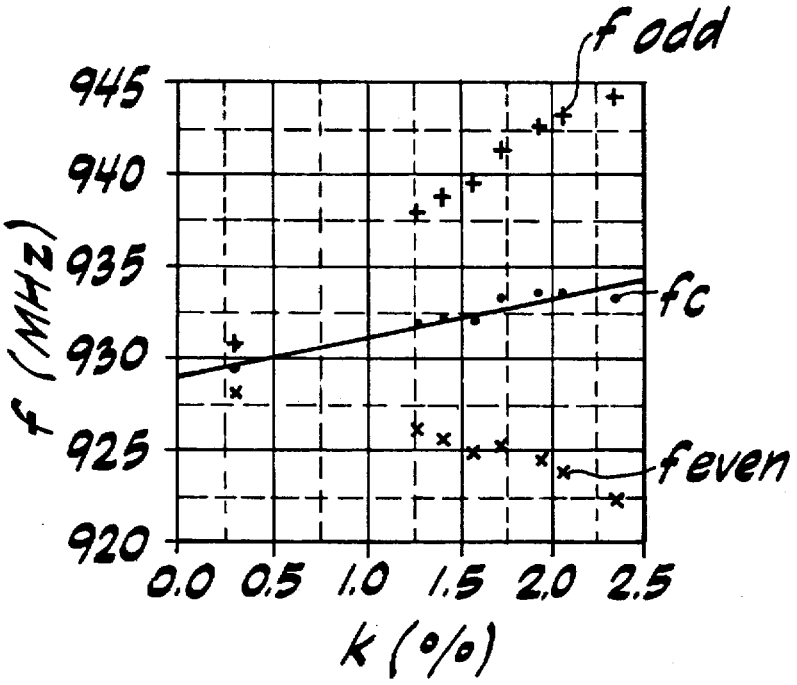
FIG. 5 shows a relationship between the coupling coefficient k and the coupling frequency $f_c$ in the dielectric resonator apparatus according to the first embodiment.

In FIG. 4, assume that x=50 mm, y=50 mm, w=15 mm, and h=12 mm. FIG. 5 shows how the coupling frequency fc changes when the coupling coefficient k is changed by adjusting the loop area of a coupling member 3 which passes through an aperture 28. As shown in FIG. 5, as the coupling coefficient k is increased, the odd-mode frequency $f_{odd}$ and the even-mode frequency $f_{even}$ move apart toward higher and lower frequencies respectively with the resonant frequency (930 MHz) of a resonator itself being at the center. In this example, the changes in the coupling frequency is only about 4 MHz even when the coupling coefficient changes by 2.5%. This change in the coupling frequency can be made smaller, to approximately 0, by specifying the length, width, and height of the coupling member 3, the dimensions of the window, and other factors appropriately.

Figure 6A:
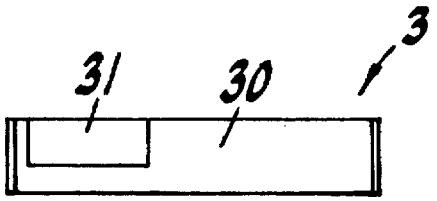
FIGS. 6(A), 6(B) and 6(C) show a configuration of a coupling member used in a dielectric resonator apparatus according to a second embodiment.
Figure 6B:
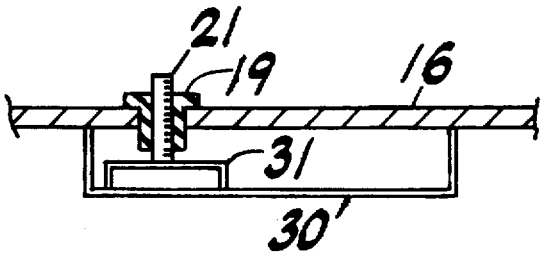
Figure 6C:
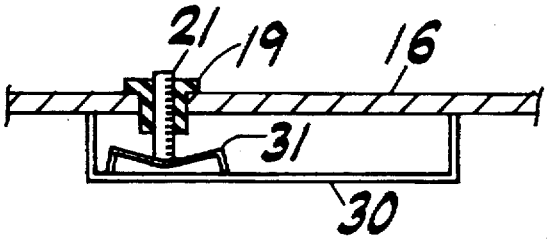

FIG. 6(A) is a plan view of a coupling member 3 (before being mounted to a metal panel) according to a second embodiment of the invention. The coupling member 3 includes a main conductive plate 30 and an adjusting conductive plate 31. FIGS. 6(B) and 6(C) are cross-sections showing the coupling member 3 mounted to the metal panel 16. As shown in FIG. 6(B), the adjusting conductive plate 31 is disposed at the inside of the metal panel 16 and the main conductive plate 30. A screw 21 is driven into the metal panel 16 through a screw hole 19. As shown in FIG. 6(C), by turning the screw 21, the adjusting conductive plate 31 is deformed to change the loop area of the conductive loop formed by the main conductive plate 30, the adjusting conductive plate 31, and the metal panel 16. In other words, when the screw 21 is driven toward the inside of the casing, the loop area increases and the coupling coefficient also increases. In this case, since the main conductive plate 30 is not deformed, the distance between the main conductive plate and the dielectric rods in the casings does not change and the resonant frequency of a resonator is not affected. This means that coupling adjustment can be performed independently of the resonant frequency.

Figure 7A:
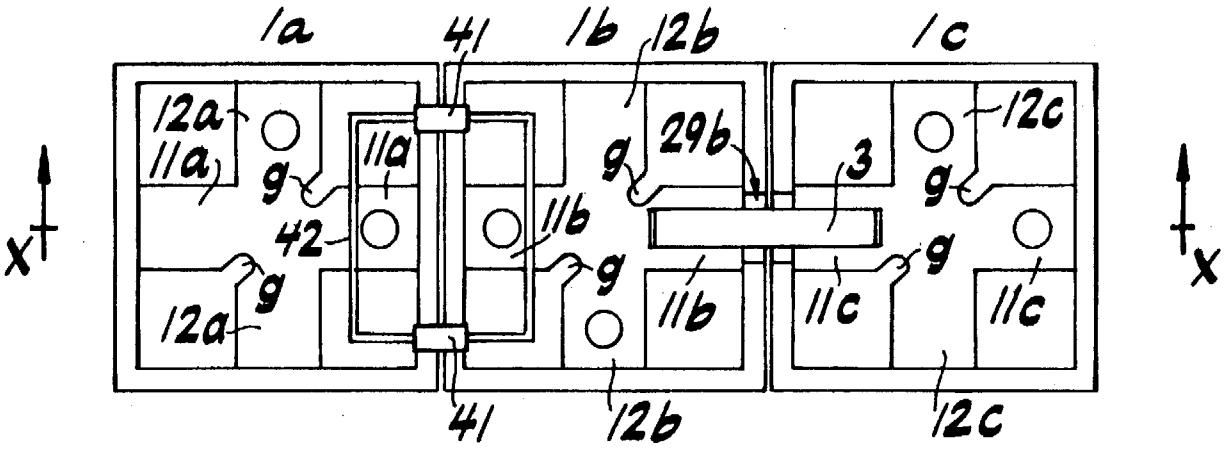
FIGS. 7(A) and 7(B) illustrate a configuration of a dielectric resonator apparatus according to a third embodiment of the invention.
Figure 7B:
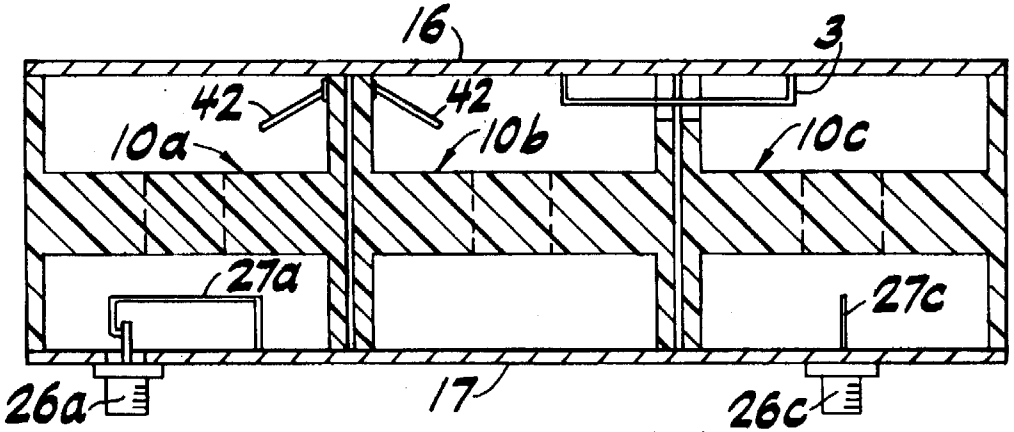

FIG. 7(A) is a top view of a dielectric resonator apparatus according to a third embodiment of the invention, before a top metal panel is mounted. FIG. 7(B) is a cross-section along the line X—X in FIG. 7(A) of the apparatus obtained after the metal panel 16 is mounted. The apparatus has TM double-mode dielectric resonators 1*a*, 1*b*, and 1*c*. Between the resonators 1*b* and 1*c*, there is provided the same coupling member 3 as that shown in FIG. 1. With this coupling member 3, two dielectric rods 11*b* and 11*c* having the same axial direction which are included in dielectric rod-complexes 10*b* and 10*c* are magnetically coupled.

There is also provided a coupling loop 42 between dielectric resonators 1*a* and 1*b*. This coupling loop 42 is mounted in loop holding apertures 41 which isolate and hold the coupling loop at opposing positions in the dielectric resonators 1*a* and 1*b*. The coupling loop 42 goes across the magnetic field generated by two dielectric rods 12*a* and 12*b* which are arranged in parallel axial directions in dielectric rod-complexes 10*a* and 10*b*. Therefore, the dielectric rods 12*a* and 12*b* are magnetically coupled through the coupling loop 42.

A metal panel 17 is provided with input and output connectors 26*a* and 26*c*. Between the central conductors of the input and output connectors 26*a* and 26*c* and the metal plate 17, coupling loops 27*a* and 27*c* are mounted. As shown in the figure, the loop plane of the coupling loop 27*c* is disposed in the direction perpendicular to the plane of the figure, and that of the coupling loop 27*a* is parallel to the plane of the figure. Therefore, the coupling loop 27*a* magnetically couples with the dielectric rod 11*a*, and the coupling loop 27*c* magnetically couples with the dielectric rod 12*c*. Since the two resonators formed by the two dielectric rods which form each of dielectric rod-complexes 10*a*, 10*b*, and 10*c* are coupled through the grooves "g" provided at their intersection, the apparatus shown in FIGS. 7(A) and 7(B) serves as a six-resonator bandpass filter.

In each complex dielectric rod, frequency adjustment holes are provided in the direction perpendicular to the plane formed by the dielectric rod-complex. When an adjusting member holding section is mounted in each casing, which holds frequency adjustment members for being inserted an adjustable distance into the frequency adjustment holes, and which holds coupling adjustment members for being inserted an adjustable distance into the grooves "g", frequency adjustment and coupling adjustment can be performed at the metal panel 16 or 17.

Figure 8:
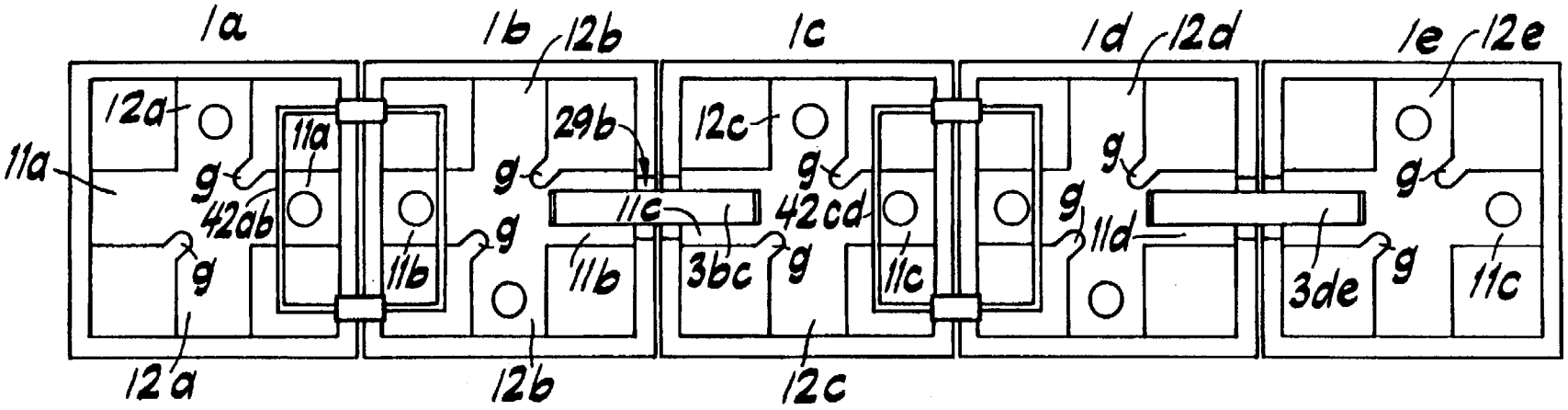
FIG. 8 illustrates a configuration of a dielectric resonator apparatus according to a fourth embodiment.
Figure 9:
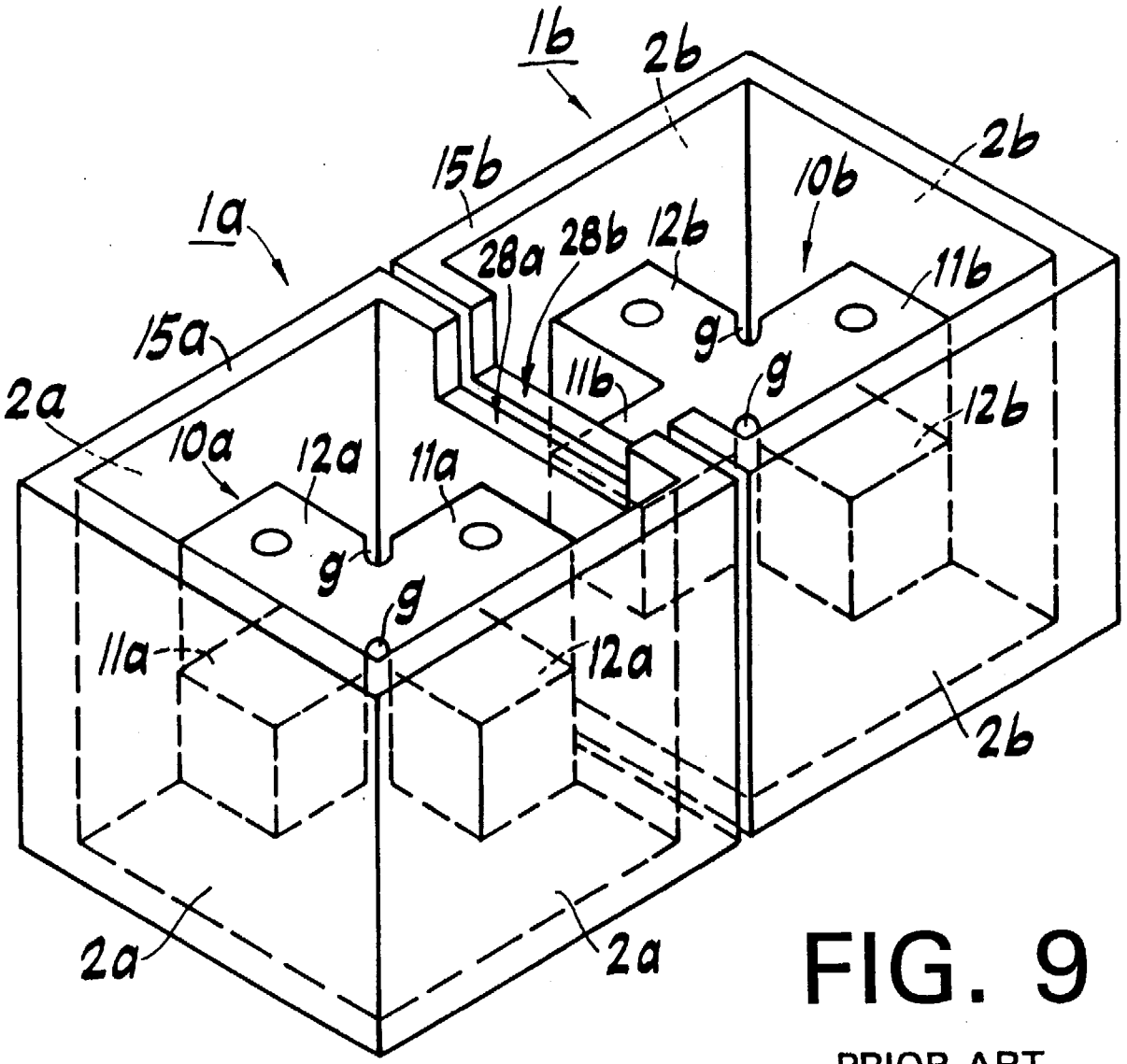
FIG. 9 PRIOR ART
FIG. 9 is a perspective view showing a configuration of a conventional dielectric resonator apparatus.
Figure 10:
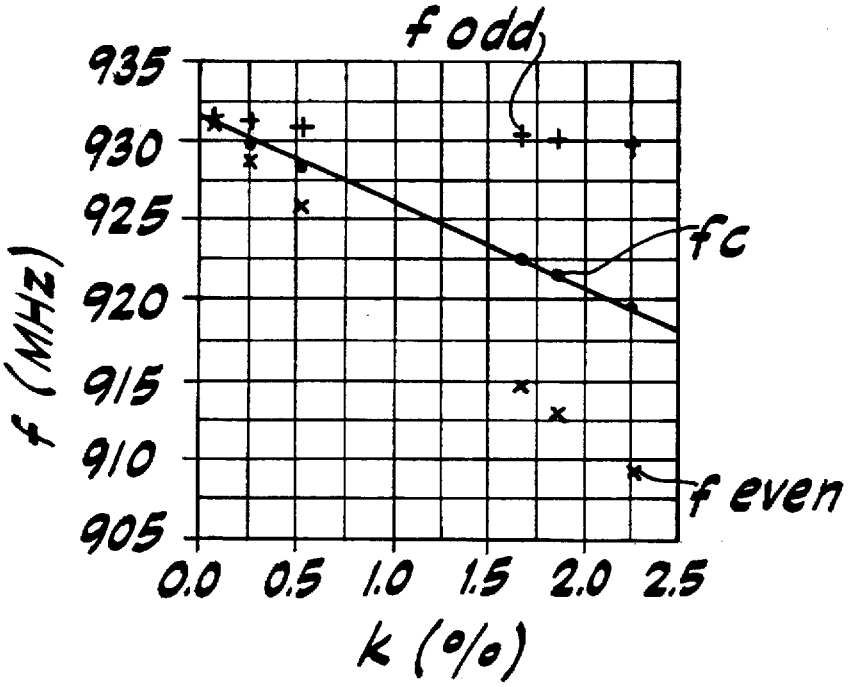
FIG. 10 PRIOR ART
FIG. 10 shows a relationship between the coupling coefficient k and the coupling frequency $f_c$, and $f_{even}$, $f_{odd}$ in the conventional dielectric resonator apparatus.

FIG. 8 shows a configuration of a dielectric resonator apparatus according to a fourth embodiment of the present invention. FIG. 8 is a top view of the apparatus obtained before an upper metal panel is mounted. In the figure, there are shown TM double-mode dielectric resonators 1*a*, 1*b*, 1*c*, 1*d*, and 1*e*. A coupling loop 42*ab* is disposed between resonators 1*a* and 1*b*, a coupling member 3*bc* is disposed between resonators 1*b* and 1*c*, a coupling loop 42*cd* is disposed between resonators 1*c* and 1*d*, and a coupling member 3*de* is disposed between resonators 1*d* and 1*e*. Thus a ten-resonator bandpass filter is obtained.

As described above, by disposing a plurality of TM double-mode dielectric resonators and disposing a first coupling device and a second coupling device alternately between them, and by using TM double-mode dielectric resonators in which two resonators in each complex dielectric rod are coupled, two dielectric resonators in each complex dielectric rod are coupled and two adjacent resonators are also coupled. Thus, a dielectric resonator apparatus made up of six, ten or another number of stages of resonators, which serves as a bandpass filter, for example, is obtained.

What is claimed is:

1. A dielectric resonator apparatus comprising:

first and second TM multiple mode dielectric resonators, said resonators being adjacent to each other, each resonator having:

a casing which has electrical conductivity; and a dielectric rod-complex disposed in said casing, said rod-complex having at least a pair of dielectric rods intersecting each other;

said casings of said first and second resonators having respective walls opposing each other, a first dielectric rod in each said casing having an axis substantially perpendicular to said opposing walls, and respective apertures in said corresponding opposing walls which pass through and cross a magnetic field generated by said first dielectric rods;

a conductive loop arranged transverse to said respective apertures which provides magnetic coupling between said first dielectric rods.

2. A dielectric resonator apparatus of claim 1, wherein said pair of first dielectric rods are substantially aligned with each other.

3. A dielectric resonator apparatus of claim 1, wherein said respective apertures of said first and second resonators oppose each other.

4. A dielectric resonator apparatus of claim 1, wherein said casings of said first and second resonators have respective top parts with a metal panel thereon; said respective apertures are formed near said corresponding top parts; and said conductive loop is formed to extend between said metal panel at said first resonator and said metal panel at said second resonator.

5. A dielectric resonator apparatus of claim 4, wherein said top parts of said first and second resonators have a common metal panel thereon.

6. A dielectric resonator apparatus of claim 5, wherein said conductive loop is conductively connected at its one end to said common metal panel at said first resonator, and is conductively connected at its other end to said common metal panel at said second resonator.

7. A dielectric resonator apparatus of claim 1 further comprising:

a conductive metal rod mounted near said conductive loop and being movable so as to adjust said magnetic coupling.

8. A dielectric resonator apparatus of claim 7, wherein:

said casings of said first and second resonators have respective top parts with a metal panel thereon;

said respective apertures are formed near said corresponding top parts;

said conductive loop is formed to extend between said metal panel at said first resonator and said metal panel at said second resonator; and said metal rod is mounted movably on said metal panel and extends toward said conductive loop.

9. A dielectric resonator apparatus of claim 7 further comprising:

a support for supporting said metal rod, provided in a wall of one of said first and second resonator casings adjacent said conductive loop.

10. A dielectric resonator apparatus of claim 9, wherein said conductive metal rod has screw threads, and said support has matching screw threads so that said magnetic coupling can be adjusted turning said metal rod to control a distance between said conductive loop and said conductive metal rod.

11. A dielectric resonator apparatus of claim 1 further comprising:

a flexible metal plate provided adjacent said conductive metal loop; and a member for pressing said flexible metal plate toward said conductive metal loop to adjust said magnetic coupling.

12. A dielectric resonator apparatus of claim 11, wherein said pressing member has screw threads and one of said first and second resonator casings has a support with matching screw threads for supporting said pressing member, so that said magnetic coupling can be adjusted by turning said pressing member to control a distance between said flexible metal plate and said conductive metal loop.

13. A dielectric resonator apparatus comprising:

a plurality of dielectric resonators, said resonators being substantially aligned in series, each of said resonators having:

a casing which has electrical conductivity;

a dielectric rod-complex disposed in said casing, said rod-complex having at least a pair of dielectric rods intersecting each other;

a pair of apertures provided in corresponding opposing walls of said casings of each adjacent pair of said dielectric resonators with each said pair of apertures being substantially aligned with each other;

a first type of conductive loop provided in at least one of said pairs of apertures, said first type of conductive loop crossing a magnetic field generated by dielectric rods substantially perpendicular to said apertures; and a second type of conductive loop provided in at least another one of said pairs of apertures, said second type of conductive loop crosses a magnetic field generated by dielectric rods substantially parallel to said apertures.

14. A dielectric resonator apparatus of claim 13, wherein said first and second types of conductive loop are provided in respective said apertures between alternate adjacent pairs of resonators, so that a dielectric rod-complex at one end of said resonator series is coupled with a dielectric rod-complex at an opposite end of said resonator series.

* * * * *